US005319864A

United States Patent [19]

Amonett

[11] Patent Number: 5,319,864

[45] Date of Patent: Jun. 14, 1994

[54] PRINTED CIRCUIT BOARD CARRIED INSIDE A CAM-OPERATED TIMER

[75] Inventor: Daniel K. Amonett, Indianapolis, Ind.

[73] Assignee: Emerson Electric Co., St. Louis, Mo.

[21] Appl. No.: 846,877

[22] Filed: Mar. 6, 1992

[51] Int. Cl.[5] ..... G04B 47/00

[52] U.S. Cl. ..... 34/528; 368/10

[58] Field of Search ..... 34/43, 44, 45; 307/596; 368/10, 11

[56] References Cited

U.S. PATENT DOCUMENTS 3,540,131 11/1970 Kahale ..... 34/45
4,166,206 8/1979 Deane et al. ..... 200/293
4,746,905 5/1988 Harima et al. ..... 340/384 E

FOREIGN PATENT DOCUMENTS 409640A 7/1990 European Pat. Off. ..... H01R 13/24
2420705 11/1979 France ..... F02B 77/08

OTHER PUBLICATIONS

European Search Report For European Patent Office Application No. 93630017.7 dated Jan. 7, 1993.

*Primary Examiner*—Henry A. Bennet
*Attorney, Agent, or Firm*—Robert F. Meyer; Eric R. Waldkoetter

[57] ABSTRACT

A dryness sensing printed circuit board carried inside a cam-operated timer housing is accomplished by bonding a printed circuit board inside a timer housing cover plate. Electrical connections between the printed circuit board and timer components are provided by conductive pads on the printed circuit board that contact an electrical connecting means attached to timer components when the timer housing coverplate is installed on the timer housing.

23 Claims, 6 Drawing Sheets

PRINTED CIRCUIT BOARD CARRIED INSIDE A CAM-OPERATED TIMER

BACKGROUND OF THE INVENTION

This invention relates to electromechanical clothing dryer timers where a component of the dryer timer is an electronic dryness sensing printed circuit board. Electromechanical dryer timers with an electronic dryness sensing printed circuit board are widely used to control automatic dryer functions.

In prior art timers, the dryness sensing printed circuit board is mounted as an isolated component usually in the dryer console. The required electrical connections between the timer male terminals and the printed circuit board male terminals are made by wires with a standard female electrical connector for the timer and a female edge connector for the printed circuit board. Mounting a printed circuit board in this manner creates increased production costs, decreased reliability, and increased service costs compared with mounting the printed circuit board inside the timer.

Production costs are increased because an additional production step is required to mount the separate printed circuit board to the appliance console in addition to mounting the timer. Costs are further increased because mounting the printed circuit board to the appliance console is usually done with screws and the procedure is difficult to automate. During the mounting process, some printed circuit boards sustain obvious damage and require replacement slowing the production line. Additionally some printed circuit boards, wiring, or connectors sustain nonobvious damage that is difficult to detect until the appliance is test operated or, in the worst case, until the appliance purchaser discovers the problem.

Reliability is decreased when the printed circuit board is mounted as a separate component because the printed circuit board and electrical connections between the printed circuit board and timer are not protected. Field data has shown that the majority of moisture sensing circuitry failures are caused by faults in the electrical connections between the printed circuit board and timer. The unprotected printed circuit board and electrical connections are exposed to vibration, moisture, and dust. These conditions are hazardous to electronic circuitry and can cause broken printed circuit boards and loose, corroded, or dirty electrical connections. A complicating factor is that the above hazards often produce intermittent circuitry failures which are difficult to troubleshoot.

Service costs are increased because of the difficulty in troubleshooting intermittent failures and the increased labor to replace separate components. Since the moisture sensing circuitry enables and disables operation of the timer, a failure in the printed circuit board or electrical connections to the timer is often mistaken for an inoperative timer. A repairperson may replace the timer thinking the problem is solved since the fault is intermittent and appears repaired. Later if the intermitted problem reappears the repairperson will have to be recalled to replace the printed circuit board, and electrical connections.

Finally, when the separately mounted printed circuit board or electrical connections to the timer fail, the failure can cause the dryer to run continuously until the dryer is manually turned off. If the dryer runs long enough, clothing in the dryer and the appliance itself may be damaged.

SUMMARY OF THE INVENTION

Accordingly a mechanism is provided to mount a dryness sensing printed circuit board inside a timer housing. In general the cam operated timing mechanism with dryness sensing circuitry comprises a housing, timer terminals carried by the housing, a motor carried by the housing, a shaft extending through the housing and driven by the motor, a cam means carried by the shaft, a plurality of switches responsive to the cam means, a printed circuit board carried inside the housing, an attaching means for fixing the printed circuit board inside the housing, and an electrical connecting means electrically connecting the printed circuit board to the timer electrical terminals.

DETAILED DESCRIPTION OF THE INVENTION

Figure 1:
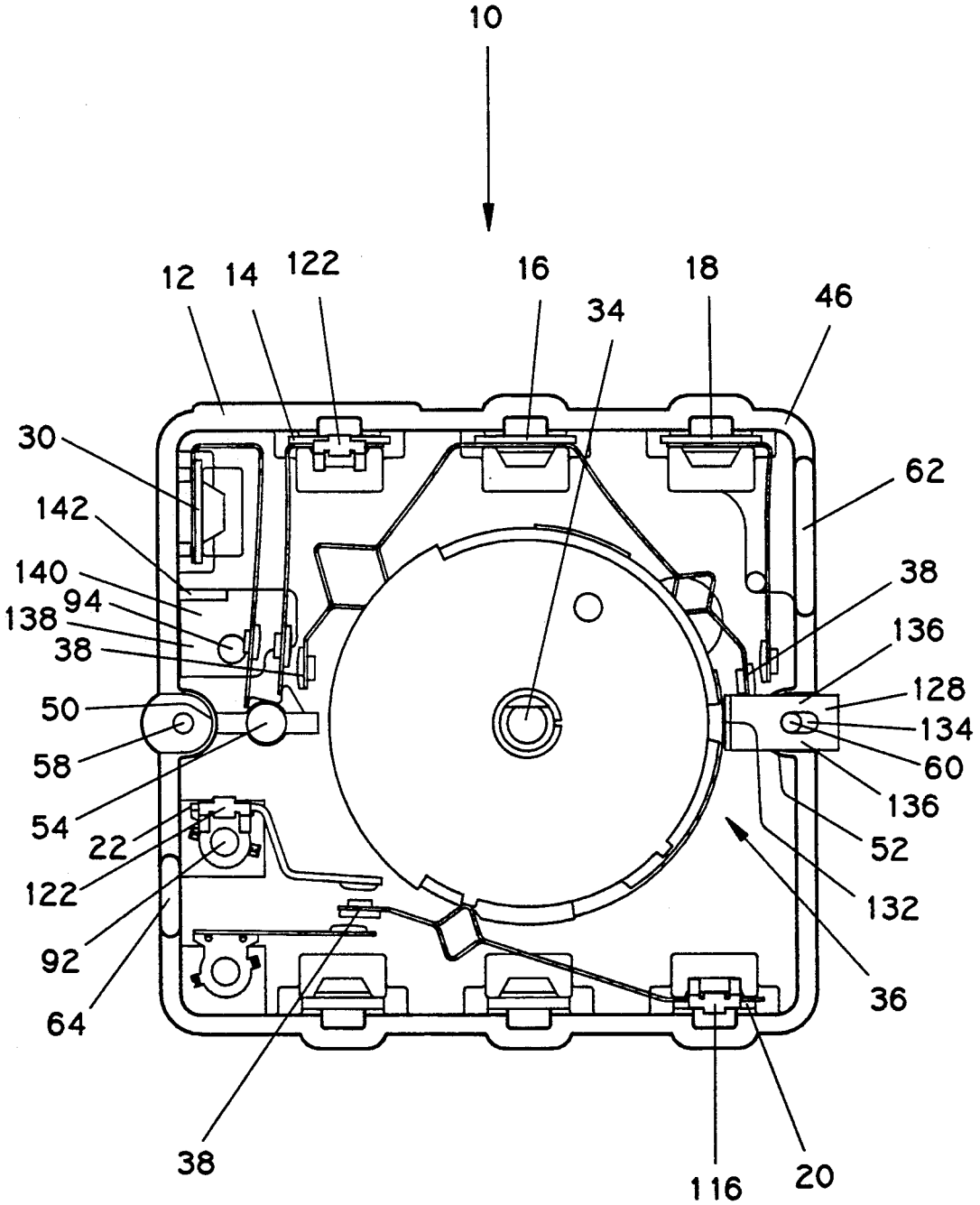
FIG. 1 is a top-view of a cam-operated timer.

Referring to FIGS. 1–4, the dryer timer 10 includes a housing 12, timer terminals 14, 16, 18, 20, 24, 28, and 30 attached to the housing 12, a motor 32 attached to the housing 12, a shaft 34 extending through the housing 12 and driven by the motor 32, a cam means 36 carried by the shaft 34, a plurality of switches 38 responsive to the cam means 36, a printed circuit board 40 attached inside the housing 12, an attaching means 42 for fixing the printed circuit board 40 to the inside of the housing 12, and a connecting means 44 (FIGS. 5–8). The connecting means 44 (FIGS. 5–8) provides a means for electrically connecting the printed circuit board 40 to timer terminals 14, 20, 24, 28 in the housing 12, and for electrically connecting the printed circuit board 40 to the motor and housing 12.

Figure 2:
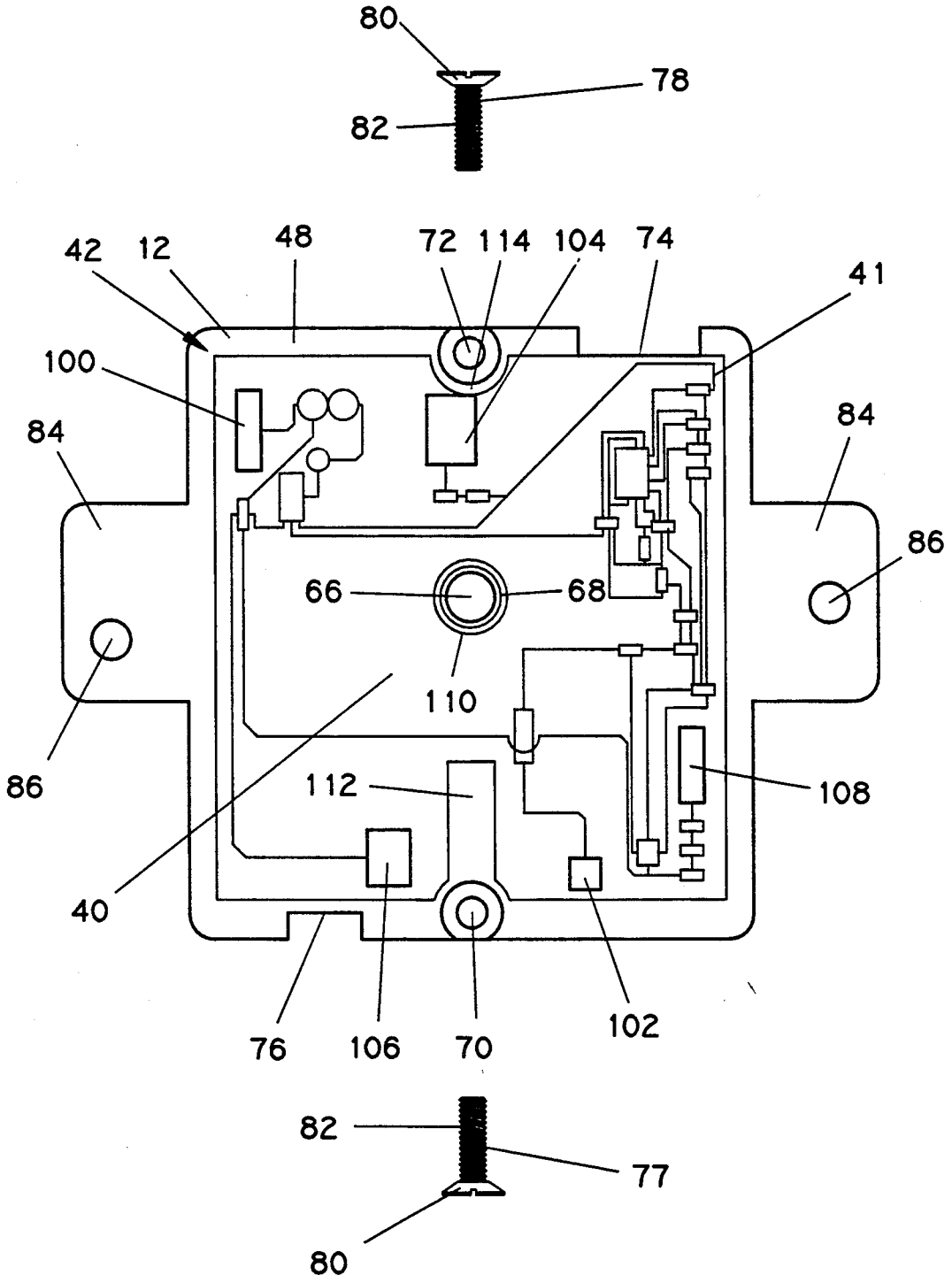
FIG. 2 is the printed circuit board attached inside a housing cover plate.
Figure 3:
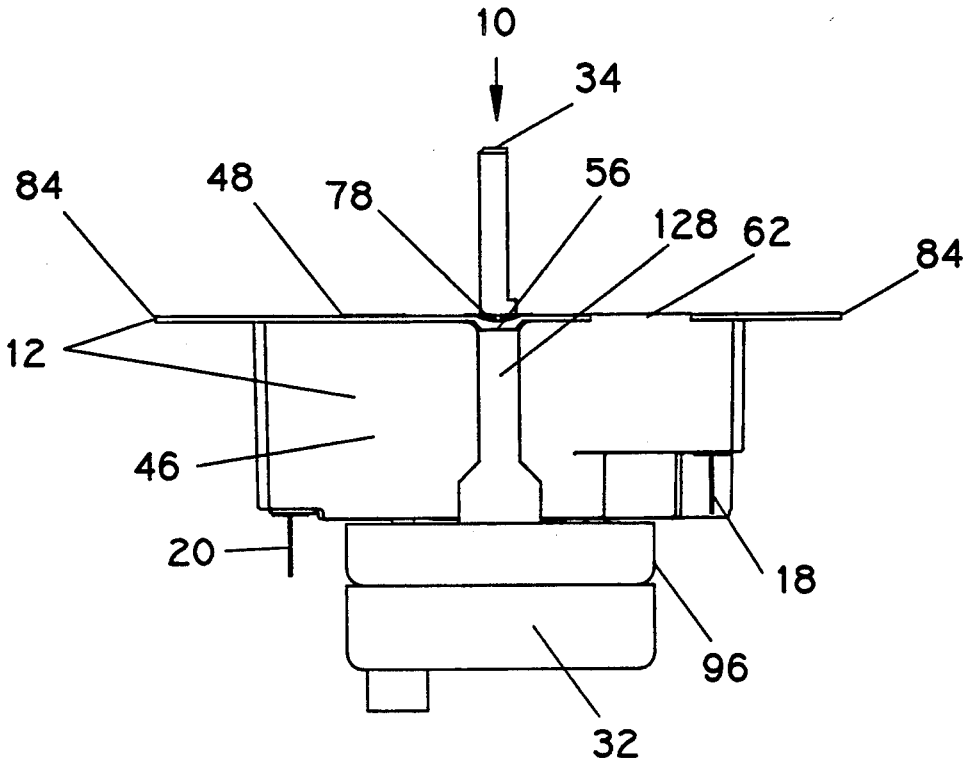
FIG. 3 is a side-view of the cam-operated timer.

Referring to FIG. 1, the housing 12 includes a housing base 46 and a housing cover plate 48 (FIG. 2). The housing base 46 includes a plain side cover plate attachment reinforcement 50, a motor side cover plate attachment reinforcement 52, a base component support protrusion 54, and a motor ground strap notch 56 (FIG. 3). The plain side cover plate attachment reinforcement 50 includes a screw hole 58, and the motor side cover plate attachment reinforcement 52 includes a screw hole 60. The housing base 46 also includes a large alignment tab 62 and a small alignment tab 64 for correct alignment of the housing cover plate 48.

Referring to FIG. 2, the housing cover plate 48 is made from an electrically conductive material and includes a shaft hole 66 with an extruded bearing 68 for rotation of the shaft 34 (FIG. 1). The housing cover plate 48 also includes a plain side cover plate attachment screw hole 70 which is countersunk and a motor ground side cover plate attachment screw hole 72 which is countersunk. The housing cover plate 48 also has a large alignment notch 74 and a small alignment notch 76. The housing cover plate 48 is attached to the housing base 46 with screws 77 and 78. Screws 77 and 78 have a screw head 80 and threads 82. The cover plate 48 has mounting wings 84 with screw holes 86 to attach the dryer timer 10 to an appliance console.

Figure 4:
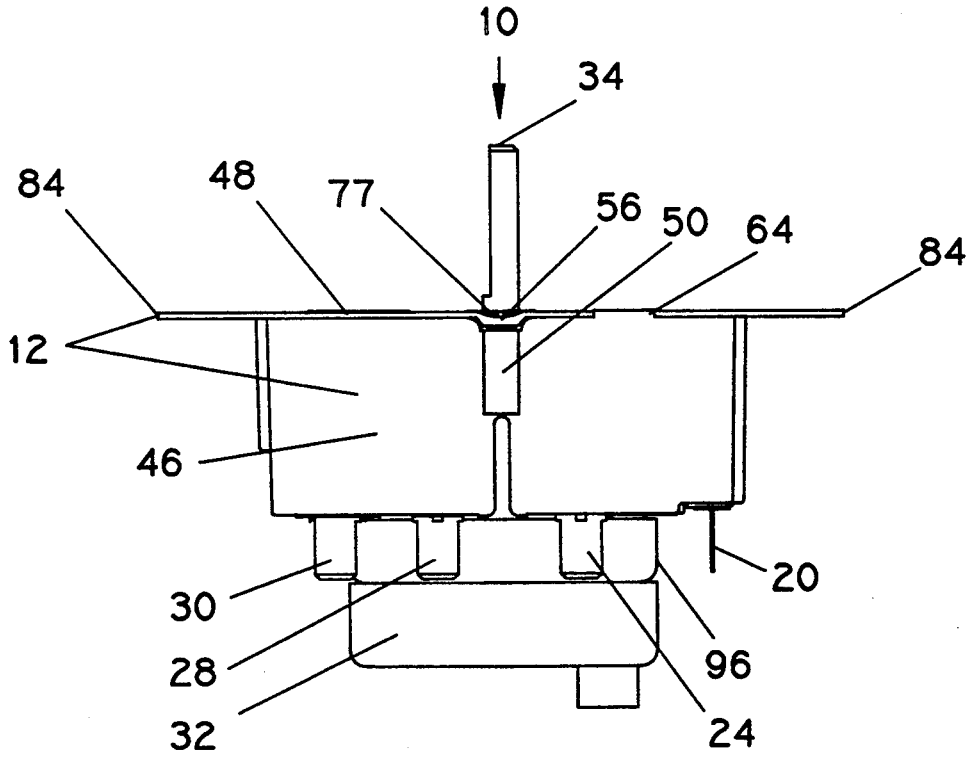
FIG. 4 is another side-view of the cam-operated timer.
Figure 5:
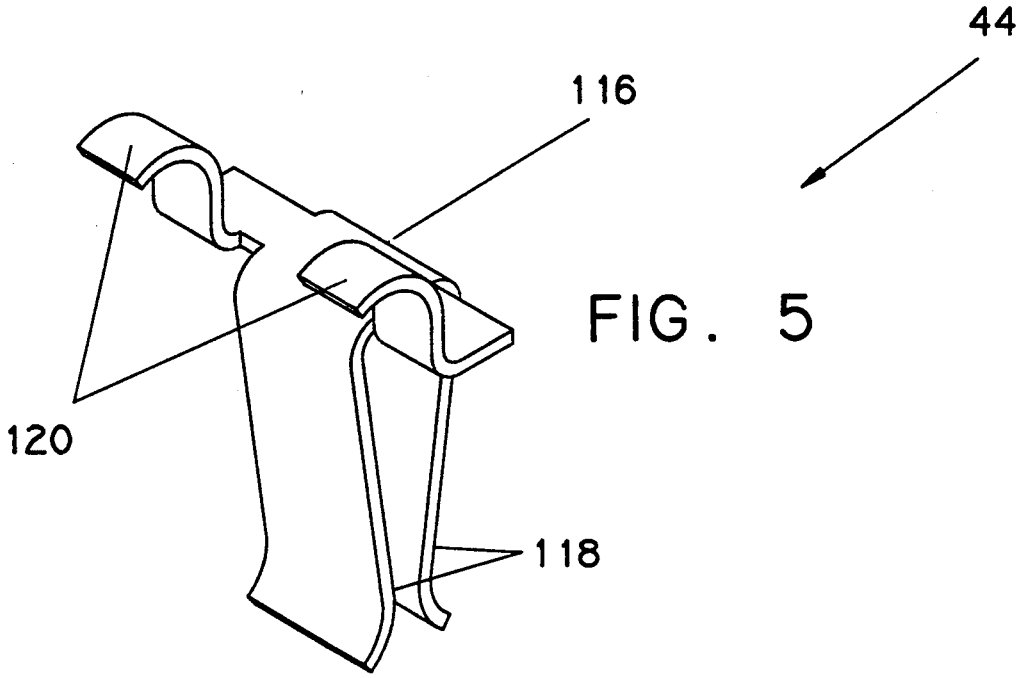
FIG. 5 is a small leaf spring connector.
Figure 6:
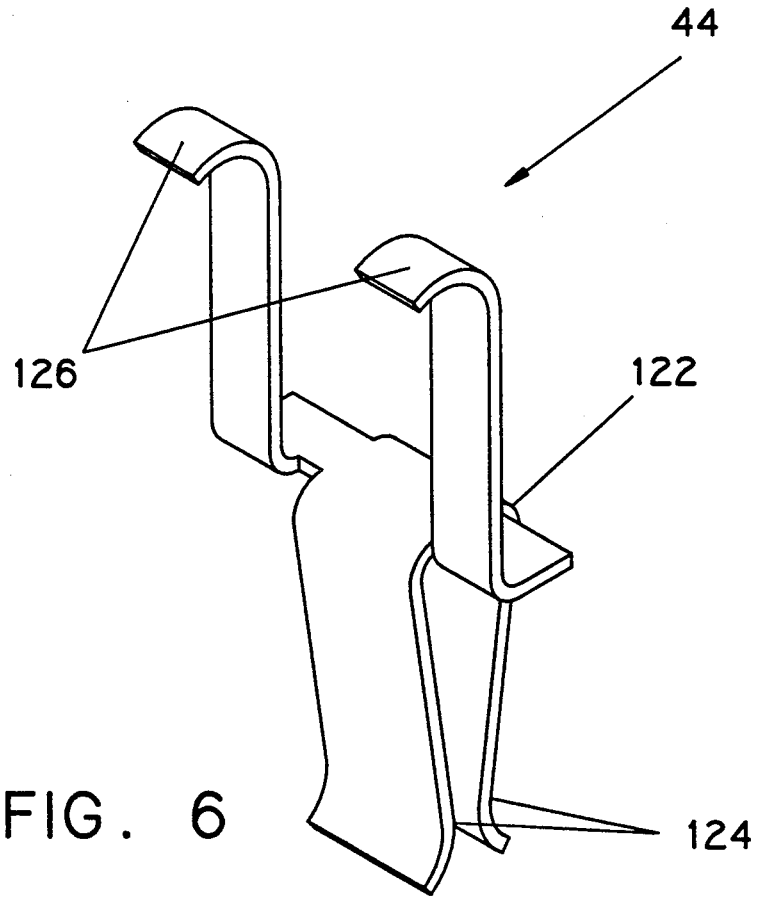
FIG. 6 is a large leaf spring connector.
Figure 11:
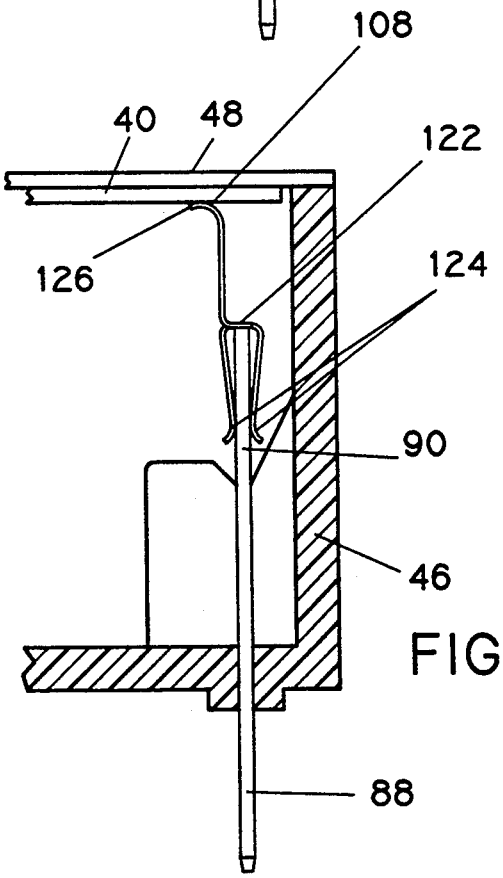
FIG. 11 is an installed leaf spring connector.

Referring to FIG. 1, timer terminals 14, 16, 18, 20, 24 (FIG. 4), 28, and 30 include a power terminal 14, a neutral terminal 20, and a motor terminal 24 (FIG. 4). The motor terminal 24 (FIG. 4) includes a motor internal connector 22. Each terminal has an exterior connection 88 (FIG. 11) and an interior connection 90 (FIG. 11), only one shown for simplicity. The power terminal 14 and the neutral terminal 20 are staked through the housing base 46 for stability. The motor terminal 24 (FIG. 4) is attached to the housing base 46 by a rivet 92. The rivet 92 attaches the motor internal connector 22 to the inside of the housing base 46 and the motor terminal 24 (FIG. 4) to the outside of the housing base 46 to provide an electrical connection and for stability. Timer terminal 28 (FIG. 4) is attached to the housing base 46 by a rivet 94. The rivet 94 attaches the moisture transducer connector 138 to the inside of the housing base 46 and timer terminal 28 (FIG. 4) to the outside of the housing base 46 to provide an electrical connection and for stability. The motor 32 (FIG. 3) includes a motor housing 96. The shaft 34 is connected to the motor 32 (FIG. 3) for rotation in a manner well known in the art.

Referring to FIG. 2, the printed circuit board 40 includes moisture sensing circuitry 41, a neutral conductive pad 100, a moisture transducer conductive pad 102, a motor ground conductive pad 104, a timer motor conductive pad 106, a power conductive pad 108, a shaft hole 110, a large housing protrusion opening 112, and a small housing protrusion opening 114. The attaching means 42 chemically bonds the printed circuit board 40 to the inside of the housing cover plate 48.

Referring to FIGS. 5–8, the electrical connecting means 44 are formed from an electrically conductive material with good spring properties such as a high performance copper, phosphor bronze, or beryllium copper and include a small double leaf spring connector 116 having a clothespin timer terminal connection 118 and a horseshoe printed circuit board connector 120; a large double leaf spring connector 122 having a clothespin timer terminal connector 124 and a horseshoe printed circuit board connector 126; a motor ground strap 128 having a lanced motor connection 130, a printed circuit board connection 132, an interference hole 134 for the housing cover plate mounting screw 78, a housing cover plate connection 136; and a moisture transducer connector 138 having a base 140, a leaf spring printed circuit board connector 142, and a hole 144 to accept the moisture transducer connector mounting rivet 94 (FIG. 1).

Referring to the drawings, operation of the device is now described. During timer 10 assembly, the electrical connecting means 44 which function as an electrical bridge between components is installed. When the motor 32 is attached to the housing base 46, the motor ground strap 128 lanced motor connector 130 is sandwiched between the motor housing 96 and the housing base 46 to electrically connect the motor housing 96 to the motor ground strap 128.

After timer terminals 14, 16, 18, 20, 24, 28, and 30, are installed in the housing base 46, the small double leaf spring 116 clothespin connector 118 is placed over the neutral terminal 20. A large double leaf spring connector 122 clothespin end 124 is placed over the power terminal 14 and another large double leaf spring connector 122 clothespin end 124 is placed over the motor internal connector 22. The spring property of the clothespin connectors 118 and 124 hold the small double leaf spring connector 116 and two large double leaf spring connectors 122 in place during assembly of the dryer timer 10.

The printed circuit board 40 that contains moisture sensing circuitry 41 is fixed to the housing cover plate 48 by an attaching means 42 that creates a chemical bond. During attachment of the printed circuit board 40 to the housing cover plate 48, the printed circuit board 40 shaft hole 110 fits over the extruded bearing 68 to assist in alignment.

The housing cover plate 48, with printed circuit board 40 attached is positioned so the shaft 34 extends through the shaft hole 66 in the housing cover plate 48. The housing cover plate 48 large alignment notch 74 and small alignment notch 76 are positioned to engage the housing base 46 large alignment tab 62 and small alignment tab 64. As the housing cover plate 48 is seated, the electrical connecting means 44 contact the printed circuit board conductive pads 100, 102, 104, 106, and 108, which appear as conductive islands on the surface of the printed circuit board 40. The small double leaf spring connector 116 horseshoe end 120 on the neutral terminal 20 contacts the printed circuit board neutral conductive pad 100; a large double leaf spring connector 122 horseshoe end 126 on the motor internal connection 22 contacts the printed circuit board 40 timer motor conductive pad 106; another large double leaf spring connector 122 horseshoe end 126 on the power terminal 14 contacts the printed circuit board 40 power conductive pad 108; the motor ground strap 128 circuit board connector 132 contacts the printed circuit board 40 motor ground conductive pad 104; and the moisture transducer connector 138 leaf spring circuit board connector 142 contacts the printed circuit board 40 moisture transducer conductive pad 102.

The housing cover plate 48 is attached to the housing base 46 with screws 77 and 78. Screw 77 is placed through the plain side cover plate attachment screw hole 70 and screwed into plain side cover plate attachment reinforcement 50 screw hole 58. Screw 78 is placed through the motor side cover plate attachment screw hole 72, through the motor ground strap 128 interference hole 134, and screwed into the motor side cover plate attachment reinforcement 52 screw hole 60.

When screw 78 is rotated for installation in the motor side cover plate attachment reinforcement 52 screw hole 60, screw threads 82 create an interference fit with the motor ground strap 128 interference hole 134 and clamp the housing cover plate connection 136 between the countersunk motor ground side cover plate attachment screw hole 72 and the motor side cover plate attachment reinforcement 52 to form an electrical connection between the motor ground strap 128 and the housing cover plate 48. Since both the plain side cover plate attachment screw hole 70 and the motor ground side cover plate attachment screw hole 72 are countersunk, when screws 77 and 78 are completely installed the screw heads 80 will be flush with the surface of the housing cover plate 48.

Figure 7:
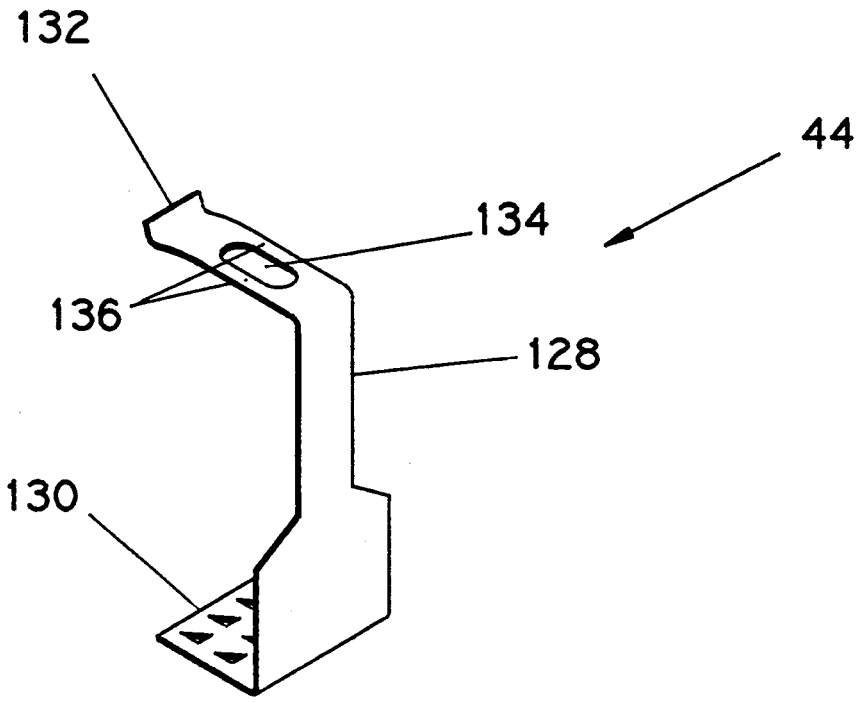
FIG. 7 is a motor ground strap connector.
Figure 8:
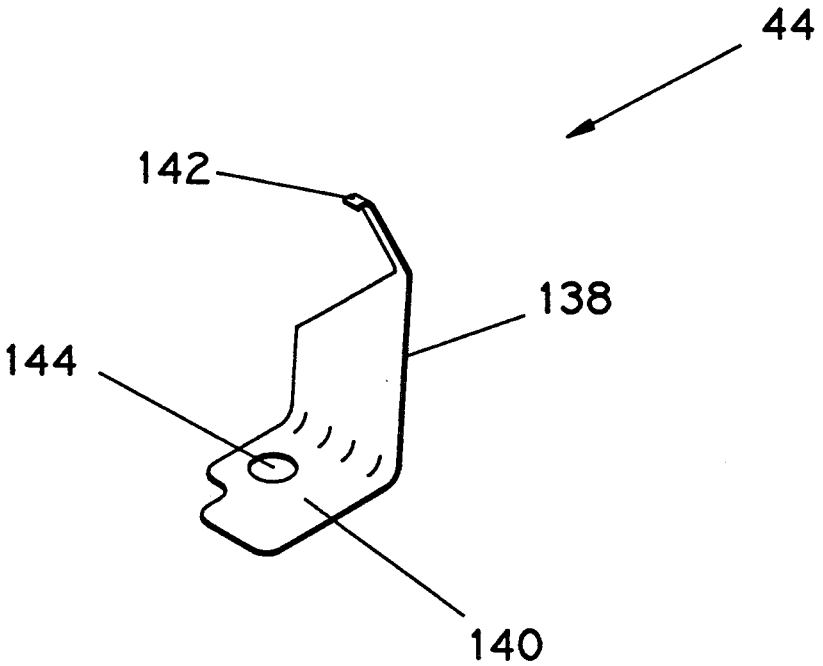
FIG. 8 is a moisture transducer connector.
Figure 9:
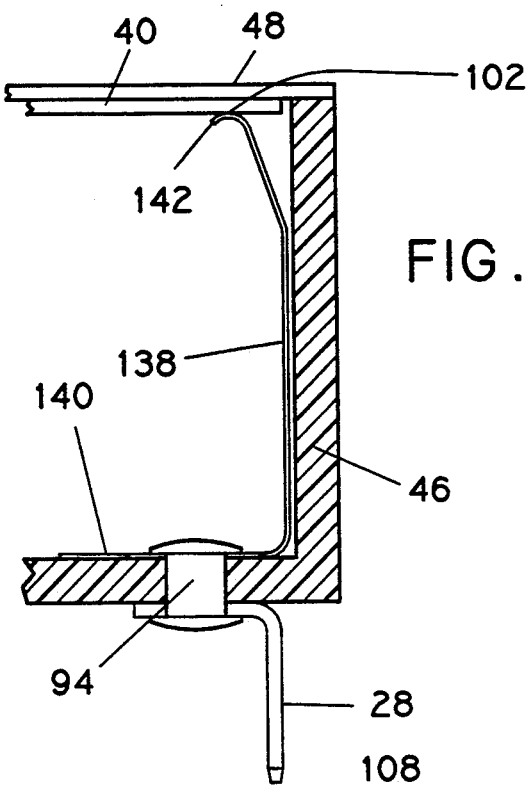
FIG. 9 is the installed moisture transducer connector.
Figure 10:
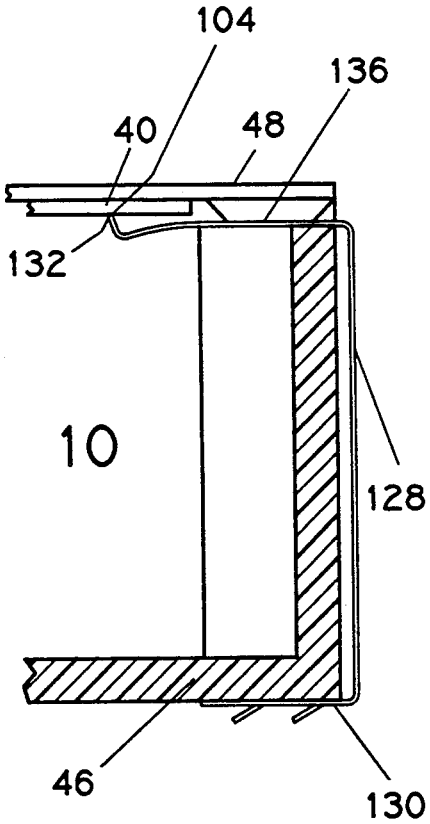
FIG. 10 is the installed motor ground strap connector.

The assembled dryer timer 10 is installed in an appliance by screwing or bolting the mounting wing 84 screw holes 86 directly to a conductive electrically grounded portion of the appliance console. Since the housing cover plate 48 is made from an electrically conductive material an electrical connection is formed between the housing cover plate 48 and the appliance console. The housing cover plate is electrically connected to the motor ground strap 128 by screw threads 82 which engage with and index the motor ground strap 128 housing cover plate connection 136 (FIG. 7). The housing cover plate 48 is electrically connected to the printed circuit board 40 by the motor ground strap 128 printed circuit board connector 132.

Because the appliance is electrically connected to the appliance console which is in turn electrically connected to the timer 10 housing cover plate 48, the motor ground strap 128, and the printed circuit board 40, there is no need for a separate ground strap between the appliance and the dryer timer 10, or the motor ground conductive pad 104 of the printed circuit board 40.

What is claimed is:

1. A timing mechanism comprising:

(a) a housing, (b) timer electrical terminals carried by said housing, (c) a motor carried by said housing, (d) a shaft extending through said housing driven by said motor, (e) a cam means carried by said shaft inside said housing, (f) a plurality of switches responsive to said cam means, (g) a printed circuit board carried inside said housing, (h) an attaching means fixing said printed circuit board inside said housing, and (i) an electrical spring connecting means electrically connecting a side of said printed circuit board to said timer electrical terminals.

2. A timing mechanism according to claim 1 wherein said printed circuit board includes a shaft hole cut into said printed circuit board receiving said shaft.

3. A timing mechanism according to claim 1 wherein said printed circuit board includes openings cut into said printed circuit board providing clearance for protrusions in said housing.

4. A timing mechanism according to claim 1 wherein said printed circuit board includes conductive pads providing an area for electrically connecting said printed circuit board to said electrical connecting means.

5. A timing mechanism according to claim 4 wherein at least one of said conductive pads includes a moisture transducer conductive pad.

6. A timing mechanism according claim 1 wherein said printed circuitboard includes moisture sensing circuitry.

7. A timing mechanism according to claim 1 wherein said attaching means chemically bonds said printed circuit board to a housing cover plate.

8. A timing mechanism according to claim 7 wherein said housing cover plate is an electrically conductive material.

9. A timing mechanism according to claim 1 wherein said timer electrical terminals include a moisture transducer terminal.

10. A timing mechanism according to claim 1 wherein said electrical connecting means includes double leaf spring connectors providing electrical connection between said timer electrical terminals and said printed circuit board.

11. A timing mechanism according to claim 10 wherein said double leaf spring connectors include:

(a) a clothespin end formed by two leaf springs to grip said timer electrical terminals, and (b) a horseshoe end formed by two leaf springs to contact said printed circuit board.

12. A timing mechanism according to claim 11 wherein said horseshoe ends are sized to bridge variable distances between said timer electrical terminals and said printed circuit

13. A timing mechanism according to claim 1 wherein said electrical connecting means includes a motor ground strap attached to said housing providing an electrical connection between said motor and said printed circuit board.

14. A timing mechanism according to claim 13 wherein said motor ground strap includes:

(a) a lanced motor connector to be sandwiched between said motor and said housing, (b) a printed circuit board connector to contact one of said printed circuit board, and (c) an interference screw hole and cover plate connection to contact said housing.

15. A timing mechanism according to claim 14 wherein said motor ground strap provides a ground connection between said motor, said printed circuit board, and said housing.

16. A timing mechanism according to claim 1 wherein said electrical connecting means includes a single leaf spring connector providing electrical connection between one of said timer electrical terminals and said printed circuit board.

17. A timing mechanism according to claim 16 wherein said single leaf spring connector includes:

(a) a flat end riveted to one of said timer electrical terminals, and (b) a spring end to contact said printed circuit board.

18. A timing mechanism comprising:

(a) a housing (b) timer electrical terminals carried by said housing, (c) a motor carried by said housing, (d) a shaft extending through said housing driven by said motor, (e) a cam means carried by said shaft, (f) a plurality of switches responsive to said cam means, (g) electronic circuitry mounted on an electronic circuitry mounting surface carried inside said housing, (h) a bonding means for attaching said electronic circuitry mounting surface inside said housing, and (i) an electrical bridging means electrically bridging said timer electrical terminals to said electronic circuitry.

19. A timing mechanism according to claim 18 wherein said electronic circuitry mounting surface includes conductive islands providing an area for said electrical bridging means to form an electrical connection to said electronic circuitry.

20. A timing mechanism according to claim 18 wherein said electronic circuitry mounting surface includes openings receiving components of said timing mechanism.

21. A timing mechanism according to claim 18 wherein said bonding means chemically attaches said electronic circuitry mounting surface to said housing.

22. A timing mechanism according to claim 18 wherein said electrical bridging means includes leaf spring connectors providing electrical connections between said timer electrical terminals and said electronic circuitry.

23. A method for mounting a printed circuit board inside a cam-operated timer comprising attaching said printed circuit board to a timer housing coverplate and electrically connecting conductive pads on said printed circuit board to timer electrical terminals with conductive spring connectors.

* * * * *